US006547004B2

(12) United States Patent
Last et al.

(10) Patent No.: US 6,547,004 B2
(45) Date of Patent: Apr. 15, 2003

(54) METHOD AND APPARATUS FOR SAMPLING LOW-YIELD WELLS

(75) Inventors: George V. Last, Richland, WA (US); David C. Lanigan, Kennewick, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 09/809,610

(22) Filed: Mar. 15, 2001

(65) Prior Publication Data

US 2002/0166663 A1 Nov. 14, 2002

(51) Int. Cl.[7] ..... E21B 49/08

(52) U.S. Cl. ..... 166/250.03; 166/66; 166/250.15; 166/264

(58) Field of Search ..... 166/53, 66, 68.5, 166/250.03, 250.15, 264, 373

(56) References Cited

U.S. PATENT DOCUMENTS

| | | | | |
|---|---|---|---|---|
| 4,489,779 | A | 12/1984 | Dickinson et al. | |
| 4,585,060 | A | 4/1986 | Bernardin et al. | |
| 4,669,554 | A | 6/1987 | Cordry | |
| 4,717,473 | A | 1/1988 | Burge et al. | |
| 4,727,936 | A | 3/1988 | Mioduszewski et al. | |
| 5,046,568 | A | 9/1991 | Cordry | |
| 5,092,988 | A | 3/1992 | Womack, II et al. | |
| 5,099,920 | A * | 3/1992 | Warburton et al. | 166/250.03 |
| 5,103,906 | A | 4/1992 | Schultz et al. | |
| 5,147,185 | A * | 9/1992 | Niehaus et al. | 417/394 |
| 5,147,561 | A | 9/1992 | Burge et al. | |
| 5,224,389 | A | 7/1993 | Jensen et al. | |
| 5,259,450 | A | 11/1993 | Fischer | |
| 5,373,897 | A * | 12/1994 | Skarvan | 166/250.03 |

(List continued on next page.)

OTHER PUBLICATIONS

Puls, R.W. and M.J. Barcelona, 1996, Low–Flow (Minimal Drawdown) Ground–Water Sampling Procedures, EPA/540/S–95/504.*

Pages from http://www.qedenv.com website re: MicroPurge, dated Jan. 22, 2001 pp. 1–6.

Pages from http://www.qedenv.com website entitled "Questions about the MicroPurge concept" pp. 1–12, dated Jan. 22, 2001.

Pages from http://www.qedenv.com website entitled "Expert flow and drawdown control for low–volume purging" pp. 1–3 dated Jan. 23, 2001.

Pages from http://www.qedenv.com website entitled "Drawdown control is now automatic with new low–flow water level meter" pp. 1–2 dated Jan. 23, 2001.

Pages from http:www.micropurge.com entitled "EPA Ground Water Issue Low–Flow (minimal drawdown) Ground–Water Sampling Procedures" pp. 1–18, dated Jan. 22, 2001.

*Primary Examiner*—David Bagnell
*Assistant Examiner*—Brian Halford
(74) *Attorney, Agent, or Firm*—Woodard, Emhardt, Naughton, Moriarty & McNett LLP

(57) ABSTRACT

An apparatus and method for collecting a sample from a low-yield well or perched aquifer includes a pump and a controller responsive to water level sensors for filling a sample reservoir. The controller activates the pump to fill the reservoir when the water level in the well reaches a high level as indicated by the sensor. The controller deactivates the pump when the water level reaches a lower level as indicated by the sensors. The pump continuously activates and deactivates the pump until the sample reservoir is filled with a desired volume, as indicated by a reservoir sensor. At the beginning of each activation cycle, the controller optionally can select to purge an initial quantity of water prior to filling the sample reservoir. The reservoir can be substantially devoid of air and the pump is a low volumetric flow rate pump. Both the pump and the reservoir can be located either inside or outside the well.

37 Claims, 5 Drawing Sheets

U.S. PATENT DOCUMENTS 5,490,561 A * 2/1996 Cardoso-Neto et al. ..... 166/105
5,611,671 A 3/1997 Tripp, Jr.
5,839,509 A 11/1998 Peterson
5,896,926 A 4/1999 Hama et al.
5,934,375 A 8/1999 Peterson
6,021,664 A 2/2000 Granato et al.
6,065,355 A 5/2000 Schultz

* cited by examiner

METHOD AND APPARATUS FOR SAMPLING LOW-YIELD WELLS

GOVERNMENT RIGHTS

This invention was made with Government support under Contract Number DE-AC0676RLO1830 awarded by the U.S. Department of Energy. The Government has certain rights in the invention.

TECHNICAL FIELD OF THE INVENTION

The present invention relates to ground water sampling instruments and techniques. More particularly, but not exclusively the invention relates to sampling instruments and techniques for low yield aquifers and perched groundwater zones.

BACKGROUND OF THE INVENTION

The quality of naturally occurring water is a matter of increasing concern. Various toxic pollutant substances derived from, for example, industrial effluents, human wastes, or natural factors of geological weathering, aging, and erosion often find their way into aquifer systems. Since aquifer systems may involve interconnected bodies of water, it is important to monitor associated groundwater at numerous locations, and because the characteristics of the groundwater usually varies with time, repetitive sampling is usually necessary. While certain characteristics of water can be monitored by detectors placed in a well which provide continuous monitoring, in most instances, more complete data is needed which can more effectively be obtained by the transport of groundwater samples to a full service laboratory.

Prior to obtaining a reliable sample, a well typically must be purged of at least the stagnant water in the well. For many groundwater wells, an operator can travel to a site and both purge the well and collect the necessary sample without delay. However, there are other wells, known as low yield wells, that do not produce a large enough volume of water to satisfy the demand of both purging and sampling without requiring a significant amount of time to accumulate water from the aquifer after being purged. The water that does accumulate in a low yield well stagnates as time passes, further compounding the problems of sample collection. For example, certain low yield wells may never accumulate enough water at any one time to obtain an adequate sample volume. In certain rather extreme situations, a well in a perched aquifer might only produce about 1 liter of water a day when about 4 liters of water are required for a full laboratory sample.

Accordingly, an operator is required to purge low yield wells in one trip and then return to take at least a partial sample after a sufficient time has passed for the accessible well water volume to recover. Depending on the volume of water accessible in the well and the required purging and sampling volumes, this may require multiple and/or extended trips to the well, driving up the time and cost of monitoring the aquifer. Moreover, in the most extreme cases, the water capacity of a single well can be so low that both purging and sampling can each require multiple trips to the well.

Therefore, there is a need for groundwater sampling techniques that reduce the time and effort involved in obtaining individual groundwater samples from perched or low yield aquifers. There is also a need for groundwater sampling techniques that reliably collect and store a sample for later retrieval without disturbing important measurable characteristics of the sample. There is also a need for a device that can automatically collect and hold a groundwater sample without requiring continual operator attendance.

These and other objectives are realized through various embodiments of the present invention.

SUMMARY OF THE INVENTION

A novel sample collection apparatus and method are disclosed for automatically collecting a fluid sample from a well.

In one embodiment the present invention provides a method of monitoring groundwater in a low-yield aquifer comprising, providing a pump, at least one water level sensor, and a controller responsive to the at least one sensor for automatically activating the pump; activating the pump when the water level reaches a first threshold as indicated by the at least one sensor; and deactivating the pump when the water level reaches a second lower threshold as indicated by the at least one sensor. The method can also include continuously activating and deactivating the pump until a desired volume of water is provided to a sample container where the sample container is initially substantially devoid of air.

In a second embodiment, an apparatus for collecting a groundwater sample from a low-yield well is provided comprising: a reservoir, a pump for removing water from the low yield well and providing the water to the reservoir; at least one sensor; and a controller for activating and deactivating the pump, the controller activating the pump to fill the reservoir at a flow rate less than about 500 ml/min in response to signals received from the sensor; wherein the controller activates the pump when the water level in the well reaches a first level as indicated by the at least one sensor, and the controller deactivates the pump when the water level in the well reaches a second lower level as indicated by the at least one sensor. The reservoir can be substantially devoid of air and adapted to receive a predetermined volume of groundwater from the pump.

In a third embodiment, an apparatus for collecting a sample from a low-yield well is provided comprising: a pump; a sample reservoir substantially devoid of air for receiving a volume of liquid for subsequent monitoring; a controller for automatically activating the pump to fill the reservoir; at least one fluid level sensor adapted to sense the level of fluid in the well and output at least one signal; wherein the controller sequentially activates and deactivates the pump in response to the at least one signal until the reservoir is filled with a predetermined volume of fluid.

In a further embodiment there is provided an apparatus for collecting a sample from a well comprising a sample reservoir for receiving a volume of liquid for subsequent monitoring; a sample bypass conduit; a pump for removing liquid from the well and providing the liquid to the sample reservoir, a multiway valve having a first position placing the pump in fluid communication with the sample reservoir and a second position placing the pump in fluid communication with the bypass conduit, a controller for automatically activating the pump and the multiway valve, at least one fluid level sensor adapted to sense the level of liquid in the well and output at least one signal, wherein the controller sequentially activates and deactivates the pump in response to the at least one signal until the reservoir is filled with a predetermined volume of liquid.

DETAILED DESCRIPTION OF THE PREFERRED EMBODIMENTS

Figure 1:
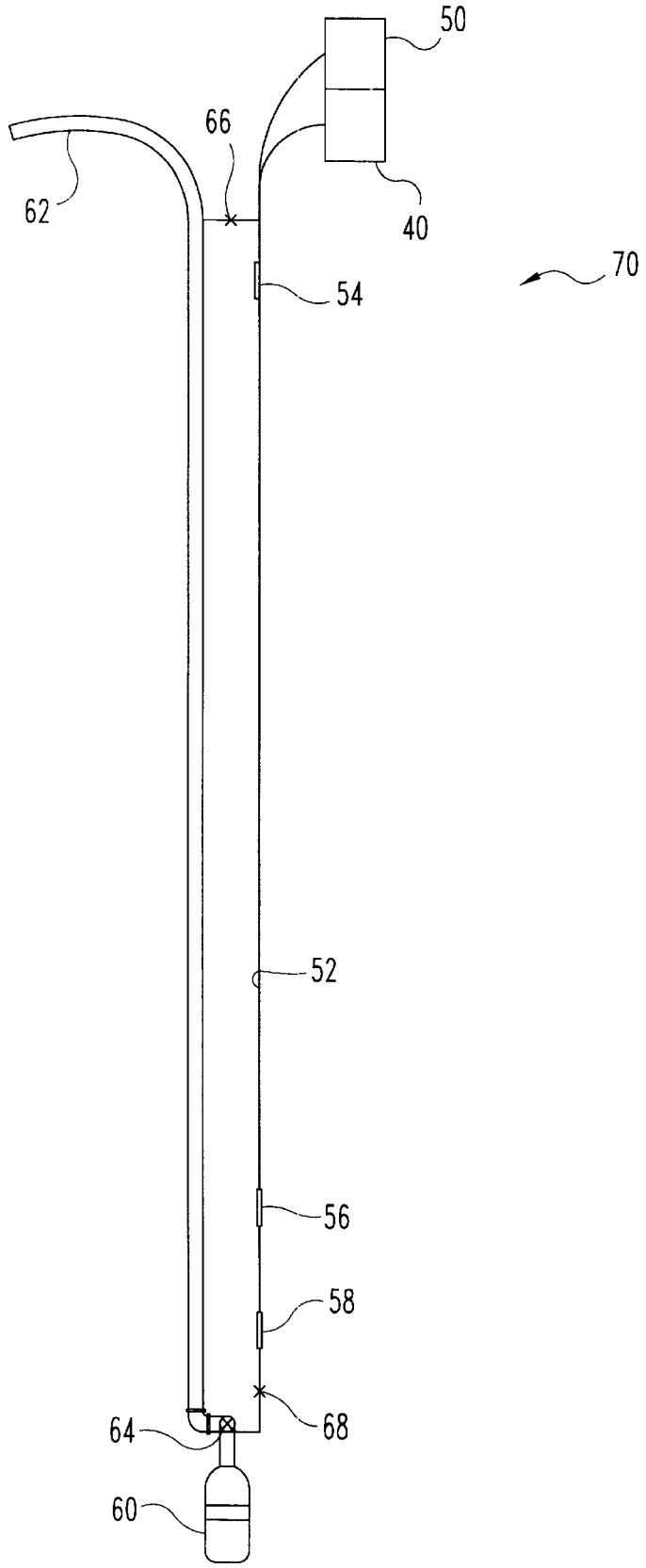
FIG. 1 is a schematic view of a sampling instrument according to an embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Turning now to FIG. 1 a groundwater sampling apparatus 70 is shown. Apparatus 70 includes pump 60, reservoir 52, and bypass tube 62 adjacent reservoir 52. Power supply 40 and controller 50 power and control pump 60 respectively, and three way valve 64 is operable to selectively place pump 60 in fluid communication with either reservoir 52 or bypass tube 62.

Reservoir 52, bypass tube 62, and pump 60 are together sized and configured to be insertable into a preexisting conventional well, for example a 2 inch well casing, such that pump 60 can fill reservoir 52 with fluid from the well. Controller 50 can be any analog or digital controller such as a conventional microprocessor, and controller 50 is programmed to activate and deactivate pump 60 in response to signals from sensors 56 and 58. Sensors 56 and 58 are disposed on the exterior of reservoir 52 and connected by signal lines to controller 50.

When placed in the well, sensors 56 and 58 provide indications of the fluid depth in the well to controller 50. Controller 50 also communicates with sensor 54 inside reservoir 52. Sensor 54 provides controller 50 with an indication of fluid depth in the reservoir 52, and as will be described in more detail below, controller 50 is programmed to deactivate pump when the fluid depth in the reservoir reaches a desired level.

Figure 2:
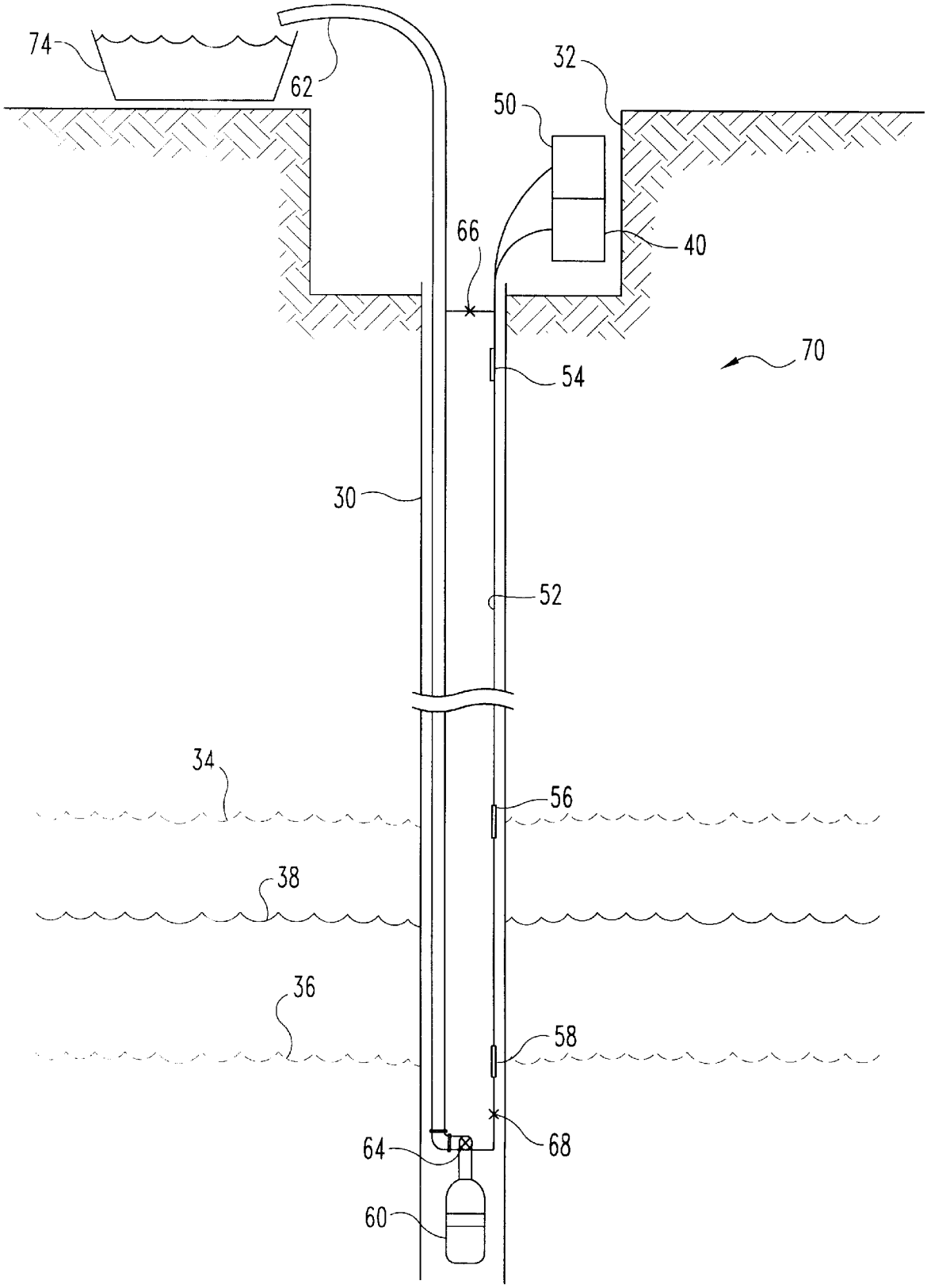
FIG. 2 is a schematic of the FIG. 1 sampling instrument in a well.

Turning now to FIG. 2 and with continued reference to FIG. 1, apparatus 70 is shown secured in well casing 30 to a fixed depth by any conventional method. In the illustrated embodiment, well casing 30 can be screened as is known in the art and depends from a well vault 32 for housing controller 50 and power supply 40 below ground level. Alternatively, controller 50 and power supply 40 could be located above ground. Pump 60 extends into well into operative contact with the well fluid. Sensors 58 and 56, which can be adjusted along the exterior length of reservoir 52, are fixed relative to the location of pump 60 to indicate high and low well fluid levels 34 and 36 respectively.

In operation, the well is first purged. Three way valve 64, through manual manipulation or automatically in response to a signal from controller 50, places pump 60 in communication with bypass 62 to purge well fluid into a purge container 74, some other receptacle (e.g. storm sewer) or onto the ground. Purging continues, for example in a manner equivalent to the automatic filling of reservoir 52 described below, until a predetermined criteria is met. This criteria can be the purging of a predetermined volume of fluid, purging a predetermined number of purging cycles (as described below with reference to filling reservoir 52), and/or the attainment of a predetermined fluid characteristic.

Figure 3:
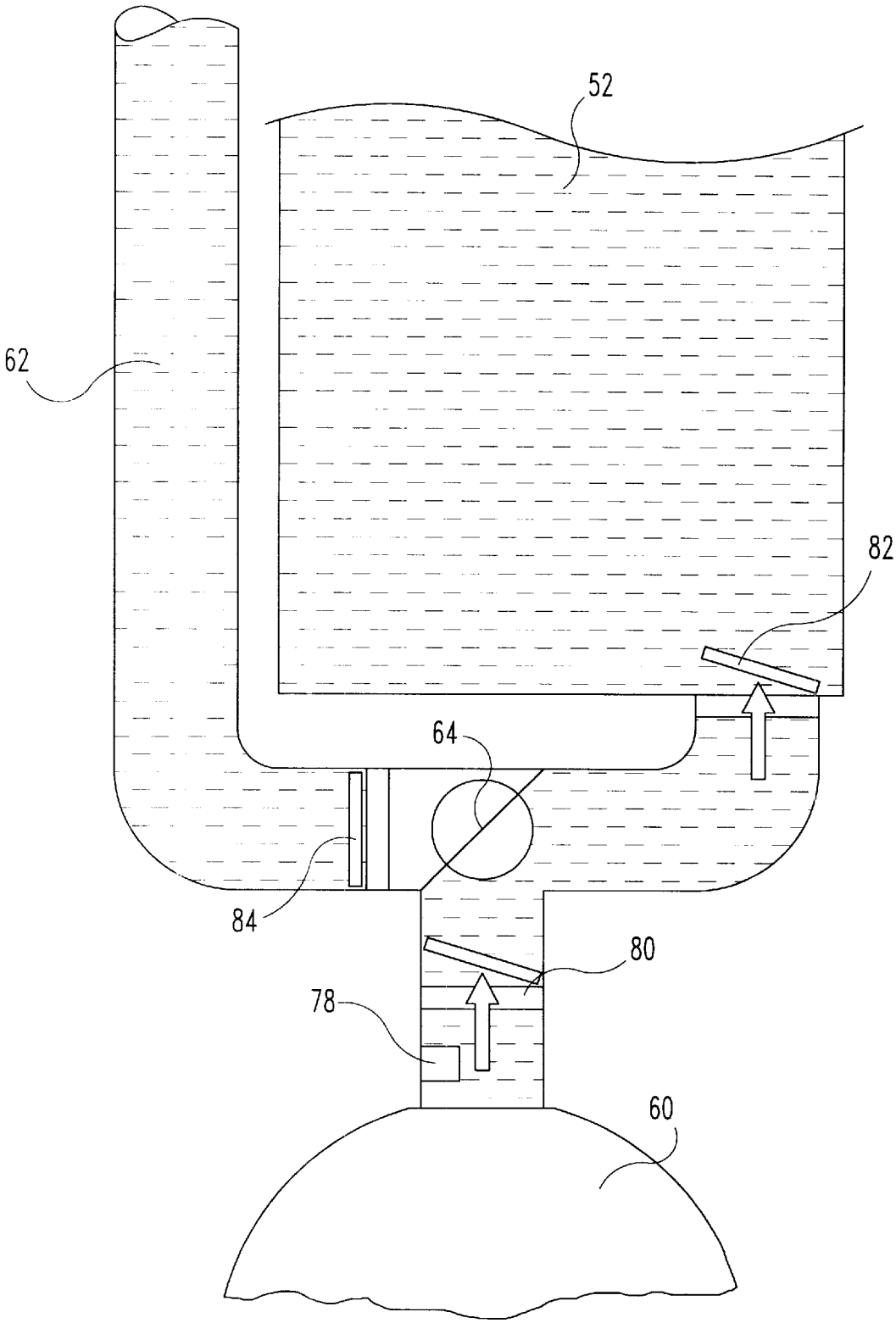
FIG. 3 is a schematic of the lower portion of the FIG. 1 sampling instrument showing fluid being pumped into the reservoir.

The predetermined fluid characteristic can relate, for example, to geochemical stability and can be either a fixed criteria or the relative stabilization of a measured value, for example fluid turbidity, conductivity, or pH. As shown in FIG. 3, apparatus 70 is equipped with turbidity sensor 78, which sends a signal to controller 50 indicating the turbidity of the water exiting pump 60. In addition to or in place of sensor 78, other sensors or probes for measuring fluid characteristics may be located at any appropriate location, for example at the inlet, outlet, or along the length of the bypass tube 62, in the bypass fluid container 74, or along or in pump 60.

After purging, three way valve 64 is operated to place pump 60 in communication with reservoir 52. When controller 50 determines that fluid level 38 has reached the high level 34, controller signals pump 60 to begin pumping. Pump 60 provides fluid to reservoir 52 thereby depleting fluid in well 30. When controller determines that fluid level 38 has reached the lower level 36, controller 50 signals pump 60 to discontinue pumping.

Controller 50 determines the relative fluid level 38 by analyzing the output of sensors 56 and 58 which are placed at relatively fixed predetermined locations along the length of apparatus 70. Sensors 56 and 58 send signals to controller 50 that depend on the relative level of fluid in the well. Sensors 56 and 58 can be any sensor from which controller 50 can determine the relative fluid level. In one embodiment, sensors 56 and 58 output a signal indicative of contact with water or any similar fluid. In other embodiments sensors 56 and 58 are combined into a single sensor (such as a pressure transducer) that outputs a signal that varies continuously with the level of fluid in the well.

Controller 50 also receives a signal from sensor 54. Sensor 54 outputs a signal indicative of the level of fluid in reservoir 52 from which controller 50 can determine when a desired volume of fluid has been collected from well 30. In the illustrated embodiment, sensor 54 is inside reservoir 52 and has a signal response that varies with contact with reservoir fluid. When the reservoir 52 contains the predetermined volume of fluid, which can be a variable amount dependent on the particular application, controller 50 signals pump 60 to discontinue pumping. Controller 50 can also signal a communications member (not shown) to signal an operator, for example by radio or cellular phone, that the sample is ready to be collected and analyzed.

In operation, an operator may not know or be available to collect the sample as soon as it is collected in reservoir 52. In addition, it may require several minutes, hours, or even days to fill reservoir 52 when several on/off cycles of pump 60 and consequently several cycles of waiting for the well to reach level 34, are required. Therefore, to prevent deterioration of the sample, for example by reaction with oxygen in the atmosphere, the sample is preferably kept out of contact with air. This can be accomplished by providing reservoir 52 with an inert atmosphere or as an evacuated bladder.

When reservoir 52 is filled with an inert gas, for example nitrogen, reservoir 52 includes check valve 66 to release the gas as fluid fills reservoir 52. Alternatively, reservoir 52 can include an evacuated liner or bladder that receives sample fluid. When configured with an evacuated bladder, reservoir sensor 54 can be configured to sense a predetermined change in the volume of the bladder type reservoir. Other mechanisms to maintain a near zero head-space in the sample collection member could also be used.

Reservoir 52 contains a sample valve 68 for withdrawing the sample to be analyzed. Sample valve 68 can be located anywhere along reservoir 52. When, as illustrated in FIG. 2, valve 68 is at the lower portion of reservoir 52, reservoir 52 is removed from well 30 to conveniently access the sampled fluid. Once removed, apparatus 70 can also be cleaned and redeployed at a different sampling site.

In other embodiments, apparatus 70 can be more permanently installed at a single site for multiple sampling operations at the same site. When more permanently installed, rather than removing the entire apparatus 70, an operator can remove only the bladder or reservoir 52, which can be contained in a housing and separately removable therefrom. To be separately removable from the housing, a bladder could include an internal check valve and a quick release or breakaway coupling connection to pump 60. Alternatively the sample can be transferred from reservoir 52 by a pump (for example pump 60 or a second pump) either through appropriate modifications to bypass 62 or through a separate sample recovery conduit (not shown).

In still other embodiments, apparatus 70 can include multiple sample collection reservoirs 52, for example as a series of evacuated bladders. When one reservoir is filled, controller 50 can purge the well (if necessary) and then select the next reservoir to be filled with fluid, for example by operation of a series of fluid valves and/or a single multiway valve. With each such reservoir selectively removable, a single installation can produce multiple contained samples for removal on a defined schedule.

Each time a well pump cycles on, the well fluid is agitated resulting in, among other things, undesirable turbidity. Thus, the number of cycles of pump 60 necessary to fill reservoir 52 can adversely affect the quality of the collected sample. Also, the length of time that fluid stagnates in a well can adversely affect the quality of the sample. Therefore, the number of cycles required to fill the reservoir 52, and correspondingly the amount of time between cycles, can be adjusted by moving sensors 56 and 58 closer or farther apart to strike an optimum balance as required by the hydrodynamics or other factors of any particular well. Controller 50 can include conventional data processing equipment, such as a timer and memory, for logging and analyzing data, such as the time between successive pump activation and deactivation cycles, to assist in optimizing the operation for each sampling apparatus 70.

In addition, controller 50 can be configured to selectively activate three way valve 64 to direct turbid water to bypass 62 and more optimal water to sample reservoir 52. In one embodiment, controller 50 activates valve 64 to direct initial water from the beginning of a pumping cycle (that may be turbid) to the purge chamber or bypass tube 62. After a predetermined volume or upon the attainment of a desired minimum turbidity level, for example as indicated by sensor 78, controller 50 then activates three way valve 64 to direct water back to sample reservoir 52. At the end of a pumping cycle, controller can then activate valve 64 to select bypass tube 62 to await the next cycle and to prevent any unintended flow of fluid from the well into reservoir 52.

In addition to increased turbidity, fluid agitation, for example caused by a high fluid flow rate, can cause volatile organic compounds (VOC) to be lost from a groundwater sample, for example by partitioning of VOC's to the gas phase upon excessive agitation. Thus, while pump 60 can be any pump sufficient to remove groundwater from a well, preferably pump 60 is a low flow pump that gradually pumps the fluid at a low volumetric flow rate. In addition, gradual startup and shut down can help to preserve the integrity of the well and a groundwater sample through successive activations and deactivations of pump 60. Preferably pump 60 pumps at a volumetric flow rate of less than about 500 ml/min, more preferably less than about 400 ml/min. and most preferably between about 100 and 200 ml/min. In one embodiment pump 60 is a pump known as a WHALE® Purge Pump, made by Munster Simms Engineering, based in Bangor, Northern keland. In other embodiments, apparatus 70 can utilize appropriately modified components of the MICROPURGE® Basics system market by QED Environmental Systems, Inc., having a place of business in Ann Arbor Mich., such as the WELL WIZARD® Bladder pump. A sampling of other pumps useful in the present invention are detailed in Table 1.

TABLE 1

Operational Characteristics of Small Pumps for Purging and Sampling

| | Rediflo 2 Submersible Pump | QED Bladder Pump | Keck Helical Rotor Pump | Fultz SP300 Gear-Drive Pump | Waterra Inertial Lift Pump |
|---|---|---|---|---|---|
| Approximate Diameter (inches | 1.81 | 1.5 | 1.75 | 1.75 | 1.0 |
| Maximum Lift (feet) | 250 | 1000 | 150 | 200 | 175 |
| Maximum Design Flow Rate (gpm) | 9.0 | 1.5 | 1.2 | 2.4 | 2.5 |
| Typical Flow Rate @ 100 ft of Lift L/min (gpm) | 29 (7.7) | 2 (0.5) | 2 (0.5) | 8 (1.9) | 8 (2.1) |
| Minimum Flow Rate Ml/min (gpm) | 100 <0.026 | 100 <0.026 | 400 0.1 | 100 <0.026 | NA NA |
| Function & Power | Electric 110-volt | Pneumatic Compressor | Electric 12 to 14.5 volt | Electric 36 or 110 volt | Electric 110 volt |

Apparatus 70 also includes a number of check valves for preventing cross contamination of fluids when cycling the pump or when switching from bypassing to filling the reservoir 52 and vice versa. As shown in FIG. 3, three separate one way check valves 80, 82, 84 may be used. With valve 64 configured to direct water to reservoir 52, as indicated by the arrows, check valve 64 prevents fluid from bypass tube 62 from contaminating the collected sample. Likewise, valve 82 operates to prevent fluid from draining out of reservoir 52 between pumping cycles.

While apparatus 70 has been illustrated with a separate pump and reservoir, the reservoir and pump can be combined, wherein purging could be accomplished by any known method. These configurations could utilize a bladder pump, a syringe type sampler, or an evacuated (vacuum) cylinder. Any such combined pump/reservoir can be disposed in the well and sequentially operable by controller 50 as described above.

In addition, apparatus 70 has been illustrated with an in-well pump and an in-well reservoir. Apparatus 70 could also be construed with an external pump, for example the pump marketed as a GEOPUMP® by Geotech Environmental Equipment, Inc., of Denver, Colo. or those disclosed in U.S. Pat. No. 5,611,671 to Tripp, Jr. which is hereby incorporated by reference. In addition to or in place of the external pump, reservoir 52 can be located outside of well 30, for example in vault 32. Where reservoir 52 is external to well casing 30, it is understood that sensors 56 and 58 can be provided to sense the fluid level of the well by alternative means, for example by being disposed on the fluid conduit between the well and the sample reservoir.

Figure 4:
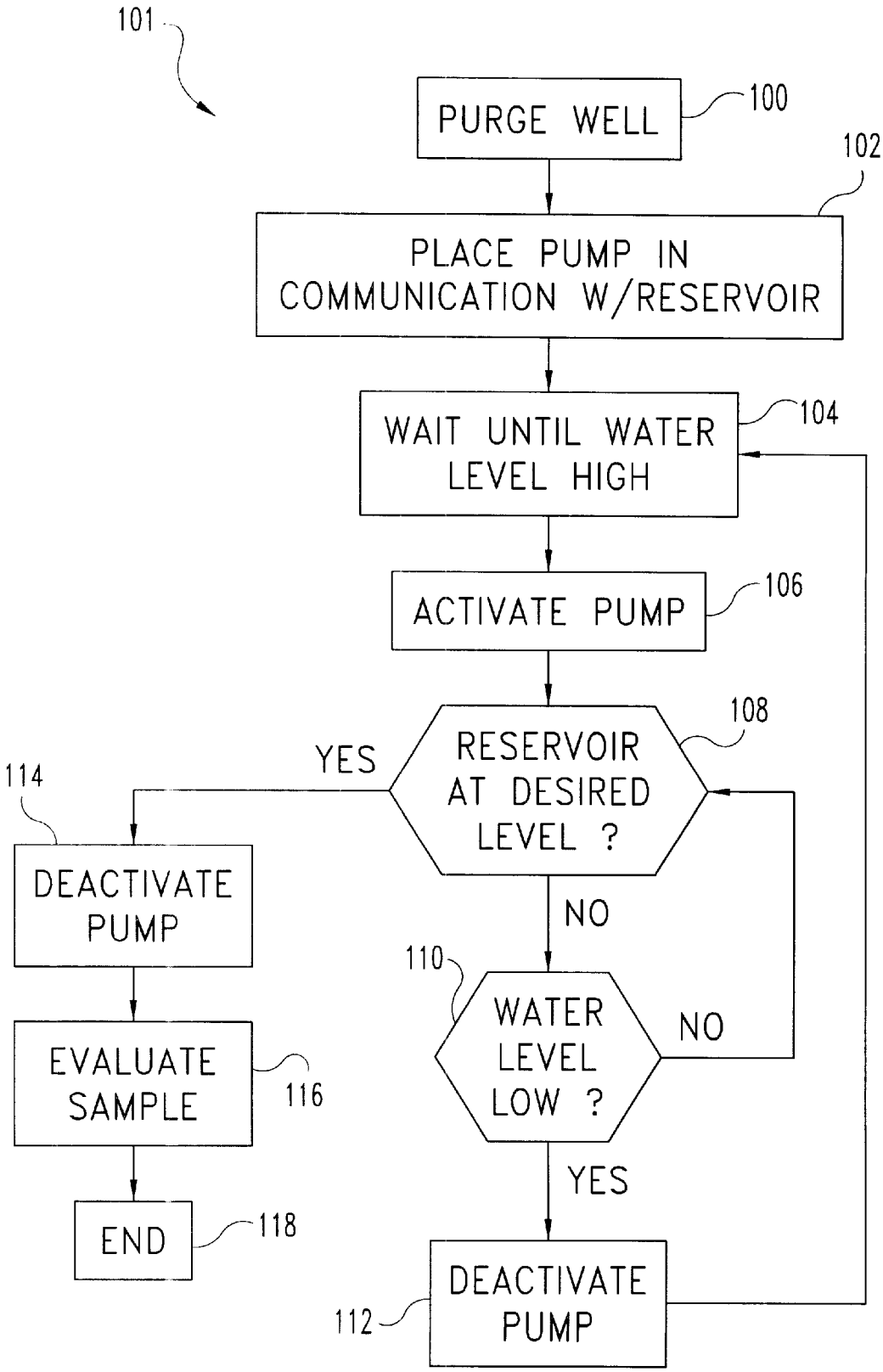
FIG. 4 is a flowchart depicting a method of collecting a groundwater sample from a low yield aquifer.

Turning now to FIG. 4, a flowchart for a process of obtaining a groundwater sample from a well is illustrated. The illustrated method 101 is particularly, though not exclusively, applicable to low yielding wells or perched aquifers. More particularly method 101 is applicable to those wells producing less than about a few liters of water over a typical 8 hour shift (those producing about 0.5 liters/hour) when about 4 liters of water are required for a full laboratory sample.

Activity 100 recites purging the well. The purging can be by any known means and generally involves using a pump to remove stagnant water from the well. Purging can occur by cyclic operation of the pump according to the procedure for obtaining the fluid sample described more fully below. Preferably, substantially all the stagnant fluid is removed from the well in the purging operation. Alternatively, purging can occur until a predetermined criteria is met such as indicated by an appropriate purge criteria sensor.

After purging, a pump, for example the same pump used for purging and preferably a low flow pump, is placed in operable relation to fill a reservoir with well water in activity 102. Since the purging likely substantially depleted the entire volume of fluid in the well the process proceeds to action 104 which calls for a wait until the water level reaches a high level. The high level is determined by an appropriate sensor(s) in the well and can be preestablished prior to purging or determined by monitoring the water level as a function of time as it rises after being depleted for the first time.

Upon attainment of a high water level the pump is automatically activated in action 106, though a predetermined delay could also be inserted after attainment of the high water level. Next the process 101 continually cycles through a decision loop until a breakout condition is satisfied. Decision 108 asks whether a reservoir is filled to a desired level and decision 110 asks whether the water level in the well is at a low level. As long as neither decision block yields a yes answer, as determined by an automated analysis of the appropriate sensors, the pump keeps pumping water to the reservoir, allowing the reservoir to be filled automatically without an operator in attendance.

When either decision 108 or 110 is yes, the pump is automatically deactivated. If the reservoir is not yet at the desired level, indicating that action 112 was taken because the water level was at the low level, process 101 cycles back to action 104 to wait until the water level is high. Otherwise, the pump is deactivated by action 114 and no further pumping is necessary to fill the reservoir.

Action 116 calls for an evaluation of the sample. This may occur by action of an operator, who can have been automatically notified of the completion of the sampling, where the operator physically takes the sample contained in the reservoir to an external lab. Alternatively or in addition, automated analysis could be performed.

The process ends at action 118 at which point the apparatus used to take the sample, including the reservoir, pump, and sensors can be cleaned and deployed at another groundwater site. The device, such as device 70 discussed above, can also be configured to allow for drainage of the purge water and/or sample water back into the aquifer after sampling and/or automated analysis has been completed.

Figure 5:
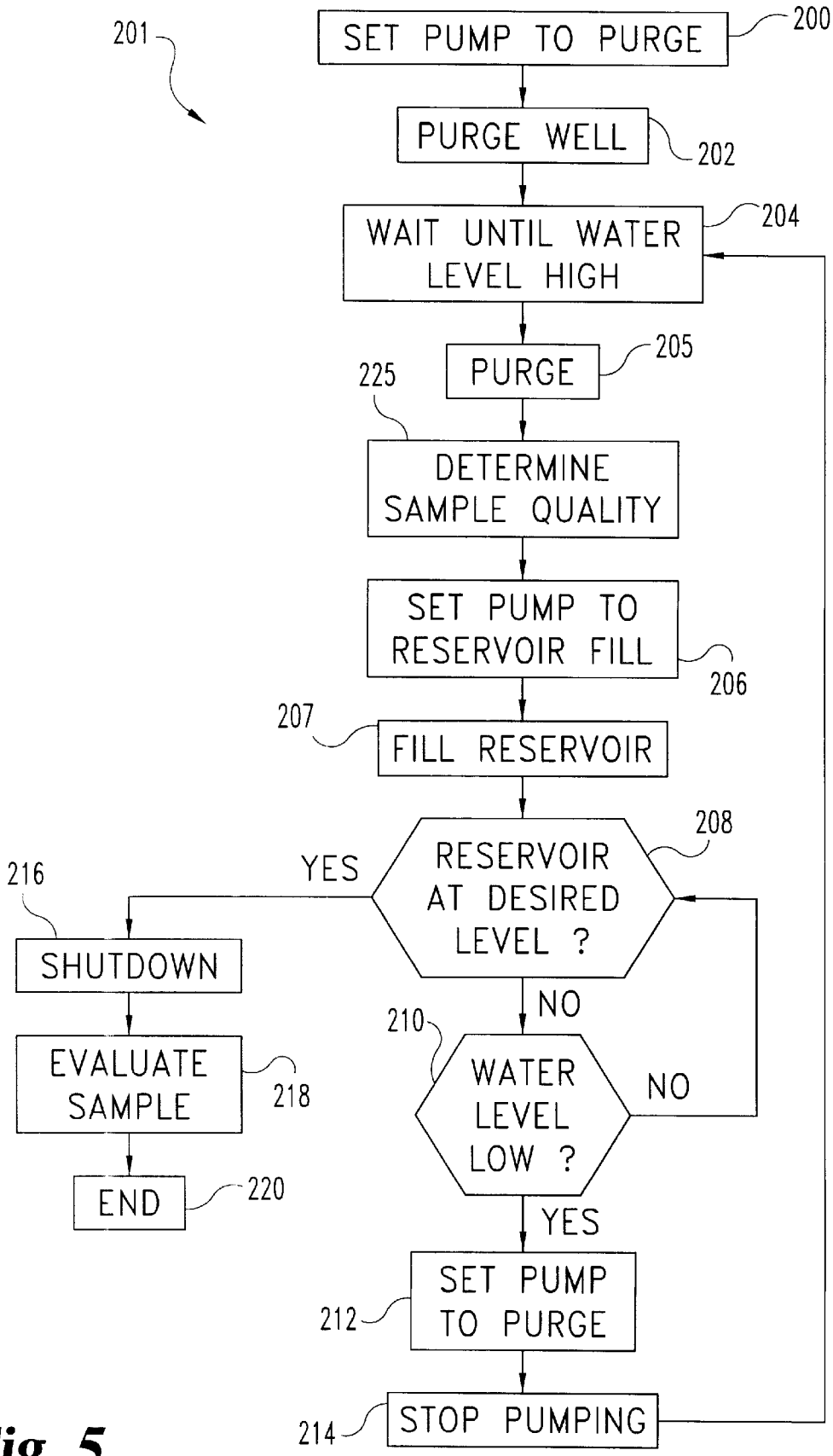
FIG. 5 is a flowchart depicting an alternative method of collecting a groundwater sample from a well.

Turning now to FIG. 5 a method of collecting a groundwater sample is provided where a single pumping apparatus is configured to both purge a well and fill a sample container. Method 201 is also particularly though not exclusively applicable to low yield wells, and method 201 is particularly applicable where a high quality/low turbidity fluid sample is desired. In one embodiment method 201 is a method of using apparatus 70 discussed above.

Method 201 begins by inserting a pumping apparatus into a well. Action 200 calls for setting the apparatus to purge the well. The apparatus can be set to purge the well by way of a valve assembly, such as three way valve 64 in apparatus 70 discussed above. The well is then purged in action 202.

After purging, action 204 calls for a wait until the water level in the well reaches a high level. Once the water level reaches the high level, the pump is activated in action 205 and begins to purge more water from the well. However, unlike activity 202, purging activity 205 only continues for a brief period during which activity 225 calls for a determination of sample quality. The sample quality can be determined to be acceptable to proceed to the next activity in several ways. The purging of a predetermined volume of fluid or the attainment of a desired low turbidity value (for example as indicated by sensor 78 in apparatus 70) are two possible methods of determining that the sample is of adequate quality to proceed. In the first method, it is assumed that the initial water pumped after a substantial waiting period will be of low quality. In the second method the actual quality of the water is measured. Other determination methods could also be used. In any case, operations 205 and 225 serve to divert initially pumped water (which can be of low quality) from entering the sample reservoir.

Method 201 proceeds to actions 206 and 207 by switching the pump to now fill the sample reservoir and filling the reservoir. Preferably the switching and filling occurs by activating a valve assembly without otherwise disrupting the flow of fluid from the well which began in action 205. In this way one can further ensure that the collected sample is of adequate quality.

Method 201 proceeds to decisions 208 and 210 which correspond to decisions 108 and 110 in method 101. When the water level in the well has been determined to be too low yet the sample reservoir is not at the desired level, actions 212 and 214 call for setting the pump to purge and stopping the pump. Method 201 then calls for a return to action 204 to wait until the level of water in the well reaches a high level.

When the sample reservoir is determined to be at the desired level, action 216 calls for the pump to be shut down, which can also include selecting the pump to purge. Next, the sample is evaluated by any known method (for example as described above with respect to method 101) in action 218 and method 201 ends.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of monitoring groundwater in a low-yield aquifer comprising:

(a) operating a pump to remove water from a well in a low-yield aquifer and to provide the water to a sample container substantially devoid of air;

(b) providing at least one sensor to monitor the level of water in the well;

(c) providing a controller responsive to the at least one sensor for automatically activating and deactivating the pump;

(d) activating the pump when the water level reaches a first threshold as indicated by the at least one sensor; and (e) deactivating the pump when the water level reaches a second lower threshold as indicated by the at least one sensor.

2. The method of claim 1 further comprising:

(f) repeating actions (d) and (e) at least once until a desired volume of water is provided to the sample container.

3. The method of claim 2 wherein the actions (d) and (e) are repeated at least once without a human operator in attendance.

4. The method of claim 3 wherein the pump fills the sample container at a volumetric flow rate less than about 500 ml/min.

5. The method of claim 2 further comprising:

(g) deactivating the pump when a predetermined volume of water fills the sample container.

6. The method of claim 1 further comprising switching the pump to fill the sample container after (d) activating the pump.

7. The method of claim 1 wherein the at least one sensor is a pair of contact sensors in spaced apart relation for sensing the first and second thresholds respectively.

8. The method of claim 7 wherein the pair of sensors are placed at adjustable positions along the length of a member extending into the well.

9. The method of claim 1 wherein the well produces less than about 0.5 liters of water per hour.

10. The method of claim 1 further comprising performing water quality analysis on the collected sample.

11. The method of claim 10 further comprising collecting a sample from the sample container after the deactivation for water quality analysis.

12. An apparatus for collecting a groundwater sample from a low-yield well comprising:

a reservoir substantially devoid of air;

a pump for removing water from a well in a low-yield aquifer and providing the water to the reservoir;

at least one sensor;

a controller for activating and deactivating the pump, the controller activating the pump at a flow rate less than about 500 ml/mm in response to signals received from the sensor;

wherein the controller activates the pump when the water level in the well reaches a first level as indicated by the at least one sensor, and the controller deactivates the pump when the water level in the well reaches a second lower level as indicated by the at least one sensor.

13. The apparatus of claim 12 wherein the reservoir is an evacuated bladder.

14. The apparatus of claim 12 wherein the reservoir contains a substantially inert atmosphere.

15. The apparatus of claim 12 wherein the controller deactivates the pump when a predetermined volume of liquid is transferred to the reservoir.

16. The apparatus of claim 15 further comprising a reservoir sensor for determining when the predetermined volume has been transferred to the reservoir.

17. The apparatus of claim 12 wherein the at least one sensor comprises a pair of contact sensors in spaced apart relation for sensing the first and second levels respectively.

18. The apparatus of claim 17 wherein the well normally has an accessible water volume of less than about 4 liters.

19. The apparatus of claim 12 wherein the well produces less than about 0.5 liters of water per hour.

20. The apparatus of claim 19 further comprising:

a multiway valve in fluid communication between the pump and the reservoir and controlled by the controller for selecting between purging the well and providing the water to the reservoir.

21. The apparatus of claim 20 wherein the controller switches the multiway valve to cause water to be provided to the reservoir after activating the pump when the water level in the well reaches the first level.

22. An apparatus for collecting and storing a sample from a low-yield well for subsequent analysis comprising:

a sample reservoir substantially devoid of air for receiving a volume of liquid for subsequent monitoring;

a pump for removing liquid from a low yield well and providing the liquid to the sample reservoir;

a controller for automatically activating the pump to fill the reservoir;

at least one fluid level sensor adapted to sense the level of liquid in the well and output at least one signal;

at least one reservoir sensor to sense the volume of liquid in the reservoir;

wherein the controller sequentially activates and deactivates the pump in response to the at least one signal until the reservoir is filled with a predetermined volume of liquid as indicated by the at least one reservoir sensor.

23. The apparatus of claim 22 wherein the pump operates at a flow rate of less than about 500 ml/min.

24. The apparatus of claim 22 wherein the reservoir comprises an evacuated bladder.

25. The apparatus of claim 22 wherein the controller activates the pump when the liquid level in the well reaches a first level as indicated by the at least one sensor, and the controller deactivates the pump when the liquid level in the well reaches a second lower level as indicated by the at least one sensor.

26. The apparatus of claim 25 wherein the at least one sensor comprises a pair of sensors in spaced apart relation for sensing the first and second levels respectively.

27. The apparatus of claim 22 further comprising a multiway valve in fluid communication between the pump and the reservoir and controlled by the controller for selecting between purging the well and providing the liquid to the reservoir.

28. The apparatus of claim 27 wherein the controller switches the multiway valve to cause liquid to be provided to the reservoir while the pump is activated.

29. An apparatus for collecting a sample from a well comprising:

a sample reservoir for receiving a volume of liquid for subsequent monitoring;

a sample bypass conduit;

a pump for removing liquid from the well and providing the liquid to the sample reservoir;

a multiway valve having a first position placing the pump in fluid communication with the sample reservoir and a second position placing the pump in fluid communication with the bypass conduit;

a controller for automatically activating the pump and the multiway valve;

at least one fluid level sensor adapted to sense the level of liquid in the well and output at least one signal;

wherein the controller sequentially activates and deactivates the pump in response to the at least one signal until the reservoir is filled with a predetermined volume of liquid.

30. The apparatus of claim 29 wherein the reservoir is substantially devoid of air.

31. The apparatus of claim 30 wherein the controller activates the pump when the liquid level in the well reaches a first level as indicated by the at least one sensor, and the controller deactivates the pump when the liquid level in the well reaches a second lower level as indicated by the at least one sensor.

32. The apparatus of claim 31 wherein the well is a low yield well.

33. The apparatus of claim 31 wherein the controller switches the multiway valve from the second position to the first position while the pump is activated.

34. An apparatus for collecting a groundwater sample comprising:

a reservoir;

a pump for removing water from a well and providing the water to the reservoir;

at least one sensor operable to sense the level of water in the well;

a controller for activating and deactivating the pump in response to signals received from the at least one sensor wherein the controller activates the pump when the water level in the well reaches a first level as indicated by the at least one sensor and the controller deactivates the pump when the water level in the well reaches a second lower level as indicated by the at least one sensor; and a multiway valve in fluid communication between the pump and the reservoir and controlled by the controller for selecting between purging the well and providing the water to the reservoir.

35. The apparatus of claim 34 wherein the controller switches the multiway valve to cause water to be provided to the reservoir after activating the pump when the water level in the well reaches the first level.

36. The apparatus of claim 34 wherein the reservoir is substantially devoid of air.

37. The apparatus of claim 34 further comprising at least one reservoir sensor for sensing the volume of water in the reservoir wherein the controller sequentially activates and deactivates the pump until the reservoir is filled with a predetermined volume of water as indicated by the at least one reservoir sensor.

* * * * *